US006296246B1

(12) United States Patent
Boorsma

(10) Patent No.: US 6,296,246 B1
(45) Date of Patent: Oct. 2, 2001

(54) METHOD AND APPARATUS FOR ACCURATELY MANIPULATING A SHEET

(75) Inventor: Peter Renze Boorsma, Dokkum (NL)

(73) Assignee: Neopast B.V., Drachten (NL)

( * ) Notice: Subject to any disclaimer, the term of this patent is extended or adjusted under 35 U.S.C. 154(b) by 0 days.

(21) Appl. No.: 09/475,075

(22) Filed: Dec. 30, 1999

(30) Foreign Application Priority Data

Dec. 31, 1998 (NL) ..... 1010931

(51) Int. Cl.[7] ..... B65H 29/00

(52) U.S. Cl. ..... 271/186; 271/187; 271/265.01; 198/404

(58) Field of Search ..... 271/186, 187, 271/265.01; 198/404

(56) References Cited

U.S. PATENT DOCUMENTS 3,730,326 * 5/1973 Irving, Jr. et al. ..... 198/404 X
3,744,614 * 7/1973 Shooter ..... 198/404 X
4,272,069 * 6/1981 Matthews ..... 271/182
4,558,265 12/1985 Hayashida et al. .
5,502,544 3/1996 Carolan .
5,527,121 * 6/1996 Santon ..... 400/323
5,632,587 5/1997 Coyette .
6,149,151 * 11/2000 Blanchard et al. ..... 271/270

FOREIGN PATENT DOCUMENTS 63-136762 8/1988 (JP) .
3-083448 9/1991 (JP) .

* cited by examiner

*Primary Examiner*—Christopher P. Ellis
*Assistant Examiner*—Richard Ridley
(74) *Attorney, Agent, or Firm*—Burns, Doane, Swecker & Mathis, L.L.P.

(57) ABSTRACT

For accurately manipulating a sheet, in accelerating or decelerating that sheet, another sheet or a holder for receiving a sheet in a first time interval, a quantity is measured which forms a measure for the deceleration or acceleration in the first time interval. A measuring result obtained upon measurement is required. Next, a moment at which an acceleration or deceleration of the sheet in a second time interval after said first time interval is started is determined in accordance with the registered measuring result. As a result, in a very simple manner, an accurate determination is obtained of the moment at which the intended acceleration or deceleration is to be started. Further disclosed are apparatuses for practicing the proposed method.

13 Claims, 4 Drawing Sheets

METHOD AND APPARATUS FOR ACCURATELY MANIPULATING A SHEET

FIELD AND BACKGROUND OF THE INVENTION

This invention relates to a method and an apparatus for accurately manipulating at least one sheet.

In machines that manipulate sheets, such as paper documents, it is often necessary to bring sheets from a movement into a predetermined orientation or position with a particular speed. It also occurs that sheets are to be fed at an accurately determined moment with a particular speed, for instance to add these to a sheet passing along a transport path.

Although it is very well possible as such, with advanced motor controls, to meet the requirements set in practice, there is a need for optimizing the processing speed and simultaneously simplifying the motor controls, enabling allowance of wide manufacturing tolerances and limiting the use of sensors.

SUMMARY OF THE INVENTION

It is an object of this invention to provide a solution which makes it possible to bring sheets fast and accurately into a particular position or to pass them at a particular moment with a particular speed along a particular point.

This object is achieved according to this invention by providing a method for accurately manipulating at least one sheet, in which in a first time interval the at least one sheet, another sheet or a holder for receiving a sheet is accelerated or decelerated; at least one quantity which forms a measure for the deceleration or acceleration in the first time interval is measured; at least one measuring result obtained upon measuring is registered; and subsequently a moment at which an acceleration or deceleration of the at least one sheet in a second time interval after the first time interval is started is determined in accordance with the registered measuring result.

For achieving this purpose, this invention further provides and apparatus for accurately manipulating at least one sheet, having: means for at least accelerating or decelerating at least one sheet; at least one measuring means for measuring at least one quantity which forms a measure for the deceleration or acceleration of the at least one sheet; a control means for operating the means for at least accelerating or decelerating at least one sheet; wherein the control means is arranged for obtaining in cooperation with the at least one measuring means at least one measuring result which represents a deceleration or acceleration of the at least one sheet within a first time interval, for registering the measuring result and for determining, in accordance with the registered measuring result, a moment at which an acceleration or deceleration in a second time interval is started. Such an apparatus is specifically arranged for enabling the method according to the invention to be practiced.

As a moment at which an acceleration or deceleration in a second time interval is started is determined in accordance with a measuring result obtained during another deceleration or acceleration in a first time interval, what is obtained in a very simple manner and without necessity for real-time feedback and control is an accurate determination of the moment at which the intended acceleration or deceleration is to be started to reach a particular position as fast as possible or to pass a particular point with a particular speed at a particular moment.

Further objects, features, effects and constructional details of this invention appear from the claims and the following description, with reference to the drawings.

DETAILED DESCRIPTION

Figure 1:
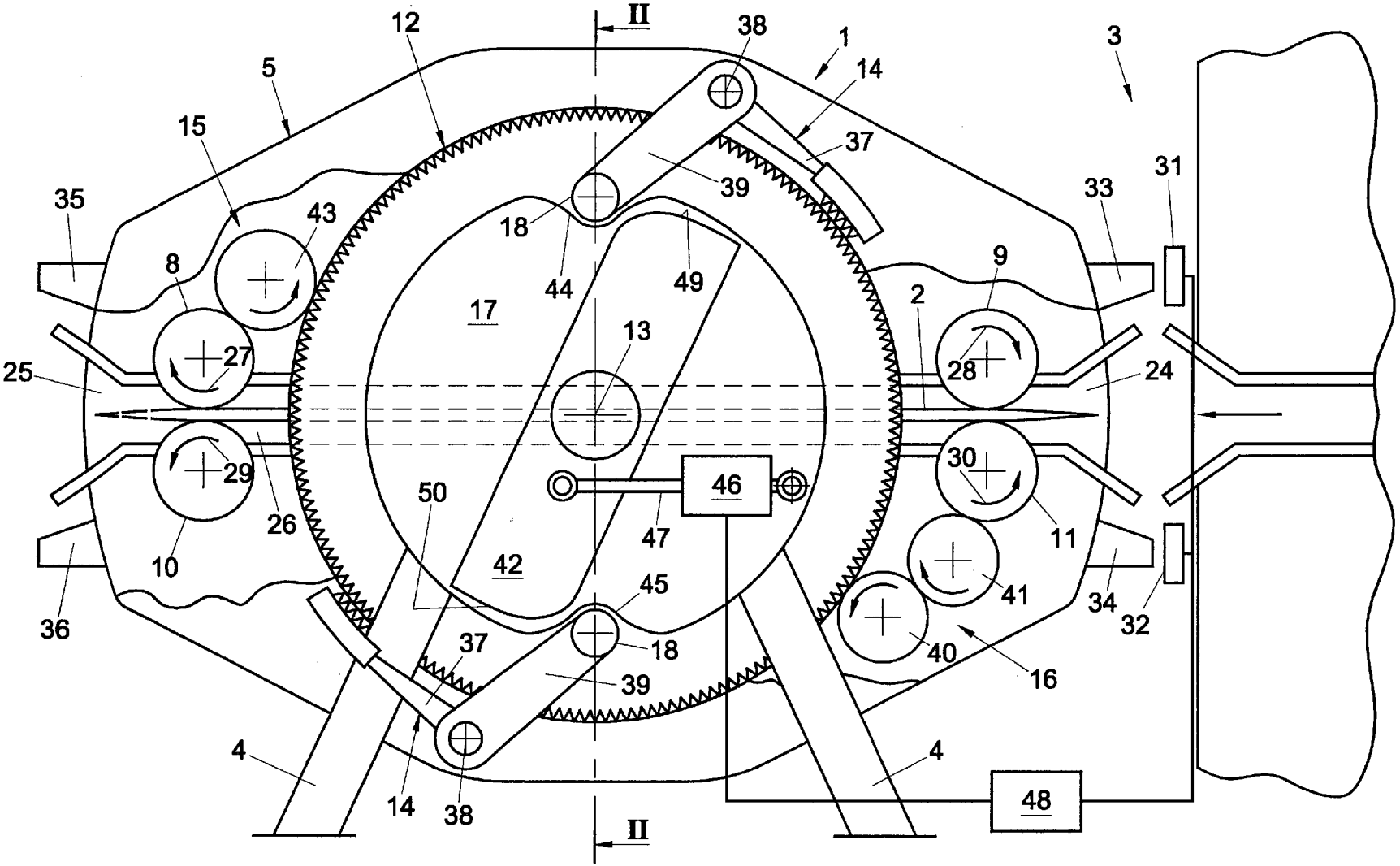
FIG. 1 is a diagrammatic representation in side elevation of an apparatus according to the invention.
Figure 2:
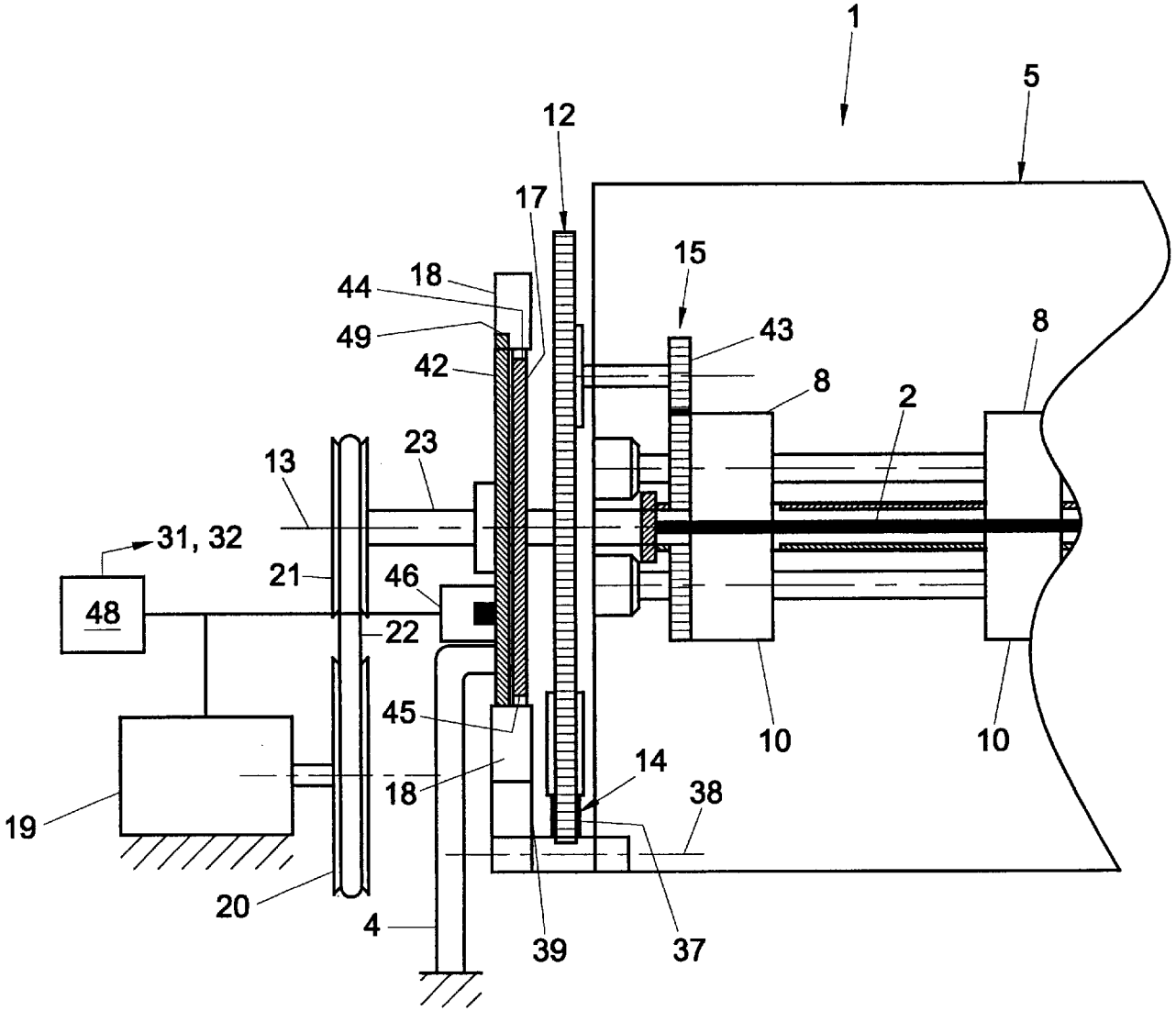
FIG. 2 is a representation in cross section taken along the line II—II of FIG. 1.

The apparatus described by way of example in FIGS. 1 and 2 constitute an example of an apparatus in which this invention can be used.

After an example of an application of the invention in the context of this apparatus has been described, some other possibilities of use will be addressed.

The apparatus 1 according to the exemplary embodiment described hereinafter is intended for rotating filled envelopes 2 which have been fed from an inserter system, of which an exit portion 3 is visible in FIG. 1. Turning over envelopes can be necessary, for instance, if a franking machine downstream of the inserter system is arranged for printing envelopes on a side opposite to the address side of the envelopes in the position in which they leave the inserter system. It may also be necessary to turn over envelopes for sorting purposes and for presenting envelopes with the desired side facing a user.

The apparatus according to the invention as proposed hereinafter by way of example is composed of inter alia:

- a frame, of which the drawing shows parts 4 while the rest has been omitted for the sake of clarity,
- a rotor 5 which is rotatably suspended relative to the frame 4 and which is arranged for receiving an object, such as the envelope 2 shown, and comprises rotary transport elements, here in the form of transport rollers 8–11,
- a transmission element 12, which, according to this example, is designed as a transmission gear wheel suspended coaxially with respect to the rotation axis 13 of the rotor 5,
- coupling grippers 14 between the transmission gear wheel 12 and the rotor 5,
- transmissions 15, 16 between the transmission gear wheel 12 and the transport rollers 8, 10 and 9, 11, respectively, of the rotor 5 for rotating the transport rollers 8–11 relative to the rotor 5 in response to rotation of the transmission gear wheel 12 relative to the rotor 5,
- a positioning structure in the form of an indexing disc 17 and indexing pawls 18 cooperating therewith, for keeping the rotor 5 in the two different positions relative to the frame 4, and
- a drive formed by a motor 19 and a transmission with pulleys 20, 21, a belt 22 and a drive shaft 23 (shown only in FIG. 2) for driving the transmission gear wheel 12.

The rotor 5 further comprises passages 24, 25 for receiving the envelopes 2 to be inverted and feeding them when inverted. Between the passages 24, 25 extends a guide track 26 for guiding envelopes 2 displaced by the transport rollers 8–11. The transport rollers 8–11 have a circulating circumferential surface and are so arranged that these circumferential surfaces can engage an envelope 2 to be transported in the guide track 26 in the rotor 5. In the position of the rotor 5 as shown, one passage 25 of the passages is located in a position for bringing an envelope 2 via that passage 25 out of the rotor. In that position of the rotor 5, the other one 24 of the passages is located in a position for receiving an envelope 2 from the inserter system 3 and for feeding a received envelope 2 via that passage 24 into the rotor.

The transmissions 15, 16 are differently designed to cause the transport rollers 8, 10 on the one hand and the transport rollers 9, 11 on the other to rotate with a mutually identical sense of rotation upon rotation of the transmission gear wheel 12. For that purpose, the transmission 16 is equipped with a set of transmission wheels 40 and a reversing wheel 41, while the transmission 15 is equipped exclusively with a set of transmission wheels 43.

By rotating the rotor 5, after an envelope 2 has been received therein, through half a turn (180°) about the rotation axis 13, an envelope 2 in the rotor is turned over. After being turned over, the envelope 2 can be discharged by rotating the transport rollers 8–11 in a direction opposite to the arrows 27–30.

The coupling grippers 14 are arranged for allowing rotation of the transmission gear wheel 12 relative to the rotor 5 in a transport condition in which the positioning structure 17, 18 retains the rotor 5 relative to the frame 4, and for retaining the transmission gear wheel 12 relative to the rotor 5 in a rotation condition in which the positioning structure 17, 18 allows the rotation of rotor 5 relative to the frame 4.

As a consequence, as the rotor 5 is carried along by the transmission gear wheel 12, a strong coupling between the rotor 5 and the transmission gear wheel 12 can be obtained, so that the rotor 5 can be accelerated and decelerated at a greatly accelerated rate. As the coupling grippers 14 allow rotation of the rotor 5 relative to the transmission gear wheel 12 when the positioning structure 17, 18 retains the rotor 5 relative to the frame 4, the resistance when rotating the transmission gear wheel 12 relative to the rotor 5, by contrast, is very small.

To reverse the sense of rotation of the transport rollers 8–11, it is necessary to reverse the sense of rotation of the transmission gear wheel 12. In order to avoid unnecessary reversal of the sense of rotation of the transmission gear wheel 12, it is preferred for the rotor 5 to be carried along with the transmission gear wheel 12 alternately clockwise and counterclockwise.

To be able to determine whether the rotor 5 approaches or has reached an end position, two ultrasound sensors 31, 32 are mounted, and the rotor 5 is provided with noses 33–36 which are located very closely in front of the distance sensors 31, 32 when the rotor 5 is in a position for receiving and feeding envelopes 2. The distance of the sensors 31, 32 to the circumference of the rotor 5, if it is non-circular in shape, is an indication of the position of that rotor 5. By virtue of the noses 33–36, the position for receiving and feeding envelopes 2 can be sensed particularly accurately because the noses 33–36 in that position bring about a particularly strong reduction of the distance between the sensors 31, 32 and the rotor 5.

Although the coupling structure 14 and the positioning structure 17, 18 can be designed as separate structures which are controlled in coordination, it is advantageous for the purpose of constructional and control-technical simplicity to couple the coupling structure 14 - as in the example described - to the positioning structure 17, 18 to cause the coupling structure 14 to engage upon release of the positioning structure 17, 18 and vice versa.

In the apparatus according to this example, this has been achieved by providing the coupling grippers 14 with tumblers 37 and by providing the positioning structure with tumblers 39 which carry the indexing pawls, and suspending the tumblers 37, 39 such that they are mutually fixed but are jointly pivotable about common rotation axes 38. Thus, the tumblers 37 move the coupling grippers 14 to their engaging position when the tumblers 39 move as the indexing pawls 18 come out of the engaging position. Obviously, there are other possible configurations in the form of which this principle can be utilized. Thus, the couplings and/or the indexing pawls can engage a transmission element or indexing structure, for instance, from the inside or axially.

For operating both the coupling grippers 14 and the positioning structure 17, 18, there is provided an operating element in the form of a switching element 42 which is pivotable about the rotation axis 13 of the rotor 5 and which is arranged for cooperation with indexing positions 44, 45 which are provided on the indexing disc 18. The switching element 42 is movable between the positions shown in solid lines, in which the indexing positions 44, 45 are cleared for receiving the indexing pawls 18, and a position represented in chain-dotted lines, in which the indexing pawls 18 are urged from the recesses. For driving these movements of the switching element 42, an electromagnet 46 is provided which is connected to the switching element 42 through an operating rod 47.

By energizing the electromagnet 46, the indexing positions 44, 45 are deactivated for allowing the rotor 5 to rotate freely. When deactivating the indexing positions 44, 45, the indexing pawls 18 are urged outwards, whereby the tumblers 39 pivot outwards about the axes 38. As a result of this, in turn, the tumblers 37 of the coupling grippers 14, which are fixedly coupled to the tumblers 39 of the indexing pawls 18, pivot inwards and set the coupling grippers 14 carried by the rotor 5 into engagement with the transmission gear wheel 12. As a result, relative rotation of the rotor 5 and the transmission gear wheel 12 is prevented, so that the rotor 5 is carried along by the transmission gear wheel 12. The indexing pawls 18, designed as bearing rollers, then run over the circumference of the indexing disc 17. As a result, the coupling grippers 14 remain reliably in engagement during rotation of the rotor 5, as long as the pawls 18 have not reached an activated indexing position yet. It is thus moreover ensured that the transport rollers 8–11, which are driven by relative rotation of the transmission gear wheel 12 relative to the rotor 5, stand still as long as the rotor 5 is not in an indexed position.

As this system utilizes a central operating element for activating and deactivating indexing positions, the number of indexing positions can be increased in a particularly simple manner, without this leading to a proportional increase of the complexity and the number of parts of the construction.

Although control of the motor 19 is possible without having knowledge of the position of the rotor 5 - for instance by only briefly energizing the motor 19 after release of rotation of the rotor 5, and subsequently allowing the rotor 5 to run out until the indexing pawls 18 fall into indexing positions 44, 45 - it is desirable, especially in the case of rotation of the rotor 5 at higher speeds, to control the motor 19 such that the rotor 5, shortly before reaching an indexed position, is slowed down and reaches the indexed position at a low speed. For that purpose, the sensors 13, 32 for detecting the position of the rotor 5 are coupled to a control system 48 which is further coupled to the central switching element 42, or at least to the electromagnet 46 for operating the central switching element 42. This control system 48 is arranged for operating the central switching element 42 (through the electromagnet 46) depending on the detected position of the rotor 5. This makes it possible to stop the rotor 5 in different predetermined positions by means of a single central switching element 42. This is especially advantageous according as the number of indexing positions 18, and hence the number of positions in which the rotor 5 can be stopped, is greater, for instance for selectively discharging envelopes in different directions.

The switching element 42 is provided with two cam surfaces 49, 50 remote from the rotation axis 13 and remote from each other in the sense of rotation. These cam surfaces 49, 50 are each associated with particular indexing position 44 and 45, respectively, and are arranged for cooperation with that indexing position for activating and deactivating that associated indexing position 44 and 45, respectively.

The positioning structure and in particular the indexing pawls 18 and the indexing positions 44, 45 are arranged for engaging over an engagement path from the rotation condition to the transport condition. The rotor 5 is then limitedly rotatable relative to the frame 4 while the indexing pawls 18 engage from the rotation condition to the transport condition, and the coupling grippers 14 and the tumblers 37, 39 are arranged for the at least limited release of rotation of the transmission gear wheel 12 relative to the rotor 5 before the indexing pawls 18 have traversed the engagement path. The effect of this is that the transmission gear wheel 12, upon reaching an indexing position, does not need to be brought to a halt but can continue to rotate, first rotating along with the rotor 5, and subsequently, with increasing rotational speed relative to the rotor 5 coming to a halt, causing the transport rollers 8–11 to rotate.

For achieving this effect, according to this example, the shape of the indexing positions 44, 45 and of the indexing pawls 18 is selected such that the tumblers 37, 39, when the rotor 5 approaches an indexing position and the indexing positions 44, 45 have been cleared by the switching element 42, already start to move sometime before the indexing position has been reached, for the release of the coupling grippers 14. Especially of importance in this connection is that the indexing positions have flowingly rising flanks.

For utilizing this effect with advantage, it is of importance that the sense of rotation of the transmission gear wheel 12 is reversed each time upon receipt of an envelope 2 in the rotor 5, so that after the inversion of the rotor 5, continued rotation of the transmission gear wheel 12 results in transport of the envelope 2 in a direction away from the inserter system 3.

Although flowingly configured flanks of the indexing positions 44, 45 can contribute to the prevention of shocks during stopping of the rotor 5, it is advantageous for a smooth and low-noise operation if elastic positioning elements are provided which, while exerting a readjusting force, allow deflections of the rotor from a position in which it is being retained. In the apparatus according to this example, this has been realized in that the indexing pawls 18 have an elastic tread. It is also possible, however, to incorporate greater elasticity, for instance, by coupling the indexing disc 17 resiliently to the frame 4.

In the apparatus described hereinbefore, the motor 19, the transmission parts 12, 20–22, the coupling provisions 14, 37 and the rotor 5 form provisions for accelerating and decelerating one or more sheets packed in an envelope 2 in the rotor 5. In order to turn an envelope 2, the rotor 5 is accelerated to a particular maximum angular speed ω and subsequently slowed down to a standstill. As has already been observed hereinbefore, it is of importance that the angular speed when reaching the indexing position where stopping is to occur, is not too high. On the other hand, for shortening the cycle time, it is of importance to have the deceleration start as late as possible. Further, it is also of importance to keep the control of the motor 19 as simple as possible, and not to have to impose stringent requirements on the predictability of the acceleration and deceleration that are feasible.

For achieving these objects, the apparatus according to this example further comprises a measuring means 51 for measuring the angular speed of the rotor 5. The curve of the angular speed over time reflects the deceleration and accelerations of the rotor 5 with the envelope 2 therein. This measuring means is formed by a current meter 51 which measures the supply current of the motor 19. The cycle time of the current strength is a measure for the instantaneous speed of the rotor 5 and can be used by the control system 48 to determine accelerations and decelerations of the rotor 5. The control system 48 is arranged to take into account only first accelerations and decelerations after operation of the electromagnet 46 for deactivating the indexing positions 44, 45, because in the case of those accelerations and decelerations of the motor 19 the rotor 5 rotates along.

The control means 48 is further also arranged for controlling the motor 19. For this purpose, possibly a control associated with the motor may be provided, which responds to control commands coming from the control system 48.

The control system 48 is further arranged for obtaining in cooperation with the measuring means 51 a measuring result which represents a deceleration or acceleration of the rotor 5, and the envelope 2 retained thereby, within a first time interval. Further, the control system contains a memory for registering the measuring result and a processor suitable programmed to determine on the basis of the registered measuring result at what moment an acceleration or deceleration in a second time interval is to be started to slow down the rotor 5 as late as possible and still to have it reach an indexing position with an angular speed below a particular maximum.

Figure 3:
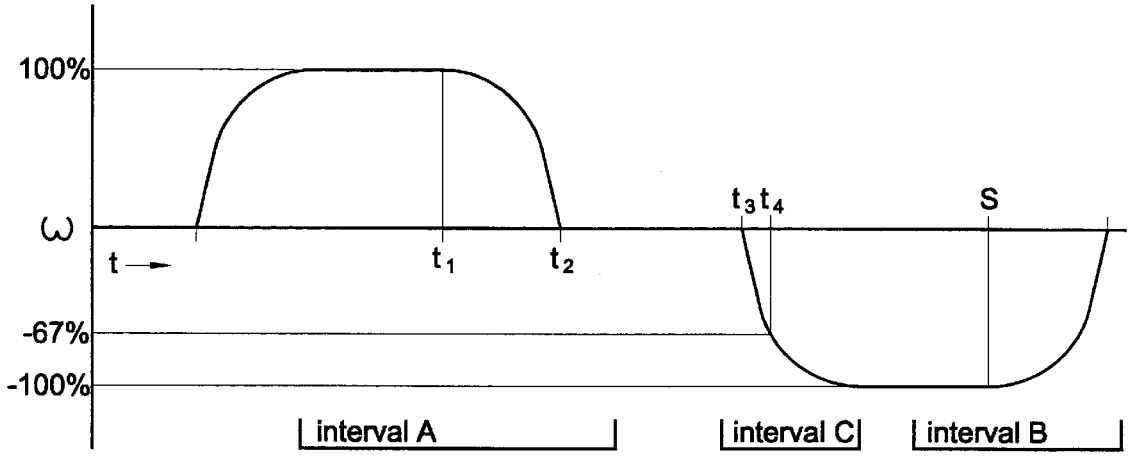
FIG. 3 is a time-speed diagram of the speed curve of the apparatus shown in FIGS. 1 and 2 in operation.

The operation of determining the moment at which the deceleration is to be started to reach a particular indexing position as fast as possible, but with a particular maximum speed, is further described on the basis of the diagram presented in FIG. 3.

As can be seen in FIG. 3, the angular speed ω of the rotor 5 is in each case raised from a standstill to a maximum value of 100% and subsequently after some time reduced to zero again. The rotor 5 is accelerated, decelerated and then accelerated and decelerated again. According to this example, the curve of the speed in time during the deceleration in the time interval A is measured and subsequently the integral of the speed during the deceleration is determined. This integral from $t_1$ to $t_2$ is the "brake path" of the rotor 5. The information thus obtained is subequently registered.

It is incidentally noted that the movement of the rotor 5 during the first time interval A can be a test movement after the start-up of the apparatus, or a movement during a predetermined turn-over cycle.

Next, the moment S is determined at which during the second time intreval B the slowing down of the rotor is to be started. To that end, starting from the acceleration from a standstill ($t_3$) the integral of the speed over time is followed. As soon as the difference between the intended turning and the completed turning is equal to the registered brake path (optionally plus a safety margin), the deceleration of the rotor 5 during the second time interval is started. Thus, in a very simple manner, a very accurate control of the movements of the rotor 5 with an envelope therein is obtained.

According to this example, the first time interval A precedes the acceleration of the rotor 5 and the quantity which is measured is the deceleration of the rotor 5 during a preceding movement. That a deceleration of the rotor 5 during a first time interval A is used for predicting the deceleration of the rotor during a next time interval B provides the advantage that an accurate prediction is possible, especially in situations where there is no strong relationship between achieved accelerations and decelerations.

Determining the brake path from a particular first speed as an indication of the moment at which deceleration is to be started provides the advantage that a prediction of the position in which the deceleration will be completed can thereby be obtained directly, which is especially advantageous when the deceleration is to be completed in a predetermined position.

When, on the other hand, the point is for a particular speed or a standstill to be achieved at a particular moment, it is more advantageous to utilize the braking time as input variable for determining the moment at which an acceleration or deceleration is to be started.

It is also possible to measure the acceleration in a first time interval C, preceding the deceleration in the second time interval B, which acceleration is part of the same movement of the rotor 5 with an envelope 2 therein as is the deceleration intended, and to use it as input variable for determining the moment at which the deceleration is to be started. To that end, according to this example, the acceleration in the time interval $t_3$ to $t_4$ is measured, with $t_4$ being marked by reaching 67% of the maximum speed. Predicting the deceleration from an acceleration which is part of the same movement as the deceleration to be predicted is especially advanageous if the deceleration greatly varies from one movement to another due to external influences, such as the weight of the sheets.

The quantity which is measured during the acceleration of the sheet in this example is the path traveled from $t_3$ to $t_4$, because it is suitable as a predictor of the brake path. Depending on the object contemplated, it may be more advantageous to measure and register the acceleration itself or the time which has lapsed from $t_3$ to $t_4$.

The motor 19 for accelerating and decelerating the rotor is formed by an electric motor. The control means is arranged for determining the moment S at which the decleration in the second time interval B is started in linear dependency on the instantaneous speed. Thus, advantageous use is made of the phenomenon in such motors, that the run-out is substantially proportional to the rotary speed.

Figure 4:
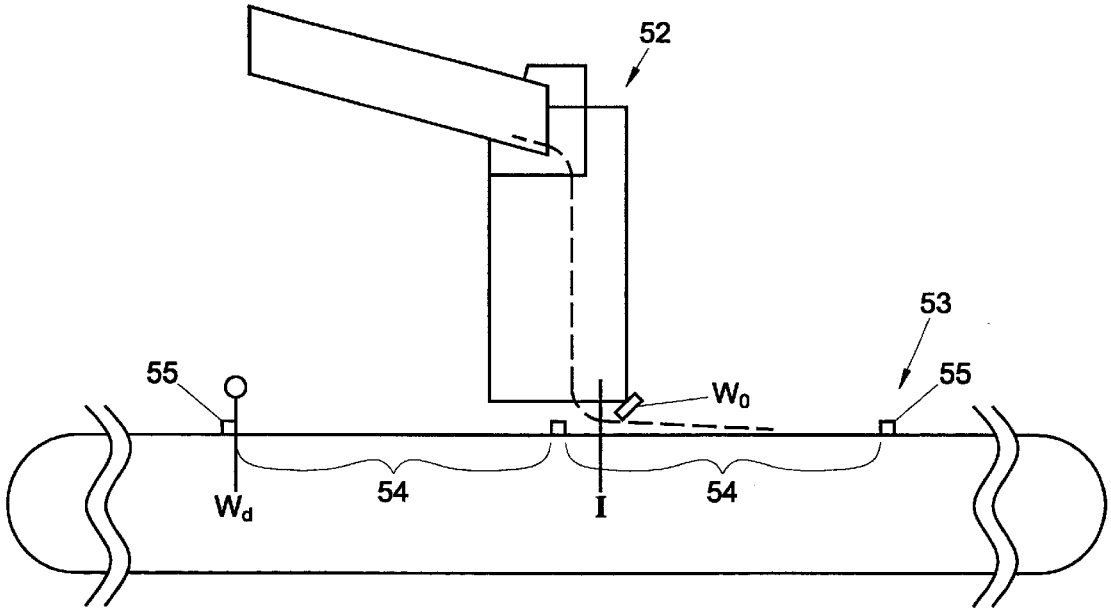
FIG. 4 is a schematic representation of an apparatus according to a second exemplary embodiment of the invention.
Figure 5:
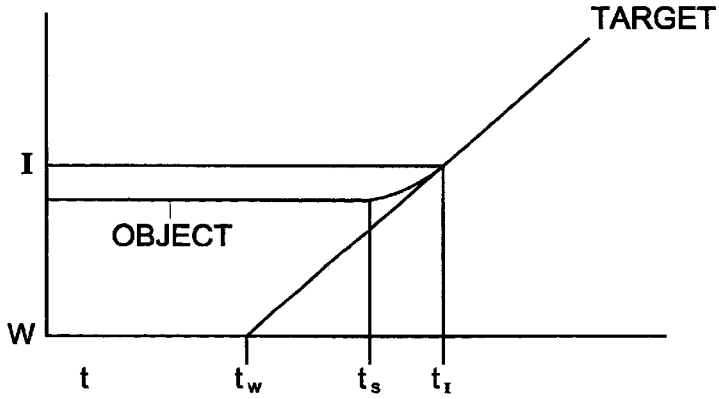
FIG. 5 is a time-place diagram regarding the displacement of objects in a direction as shown in FIG. 4.

FIGS. 4 and 5 illustrate a second application example of this invention, where the movement to be made is formed by an acceleration started at a particular moment $t_s$, followed by passing a particular point I. The quantity which is measured in the first time interval is the time duration between the start of the acceleration at a moment $t_s$ and the moment $t_I$ of passing the point I. The point here is to feed a sheet at the proper time and with a proper speed from an insert feeder 52 to a conveyor 53, all such that the sheet is accurately placed on a section 54 of the conveyor 53 extending under the insert feeder 52.

What is primarily determinative in determining the moment $t_s$ is the moment $t_w$ at which a boundary 55 of a section 54 passes a sensing point $W_d$. The point thereupon is for a sheet to arrive at point I at a moment $t_I$ with a speed equal to the speed of the conveyor. Once it has been ensured that a sheet is accelerated to the proper speed, it is just a matter of determining the moment $t_s$ at which the sheet is to be started. By measuring how long it takes for a sheet, after starting, to reach the point I, it is known by what length of time the moment $t_s$ must precede the time $t_I$. For sensing that a sheet from the insert feeder 52 has reached the point I, a sensor $W_O$ is placed there. Also known, further, is the length of time between $t_w$ and $t_I$. By calculating the difference between these time durations, it can be simply determined how long the time between $t_w$ and $t_s$ must be.

Thus, in a very simple manner, accurate feeding of sheets can be accomplished. This invention is especially of advantage if the accelerations are carried out without being controlled, because without feedback during the acceleration or deceleration to be accurately controlled and the associated rapid observation and real-time regulation of the movement, still a very accurately controlled manipulation of sheets is obtained.

Figure 6:
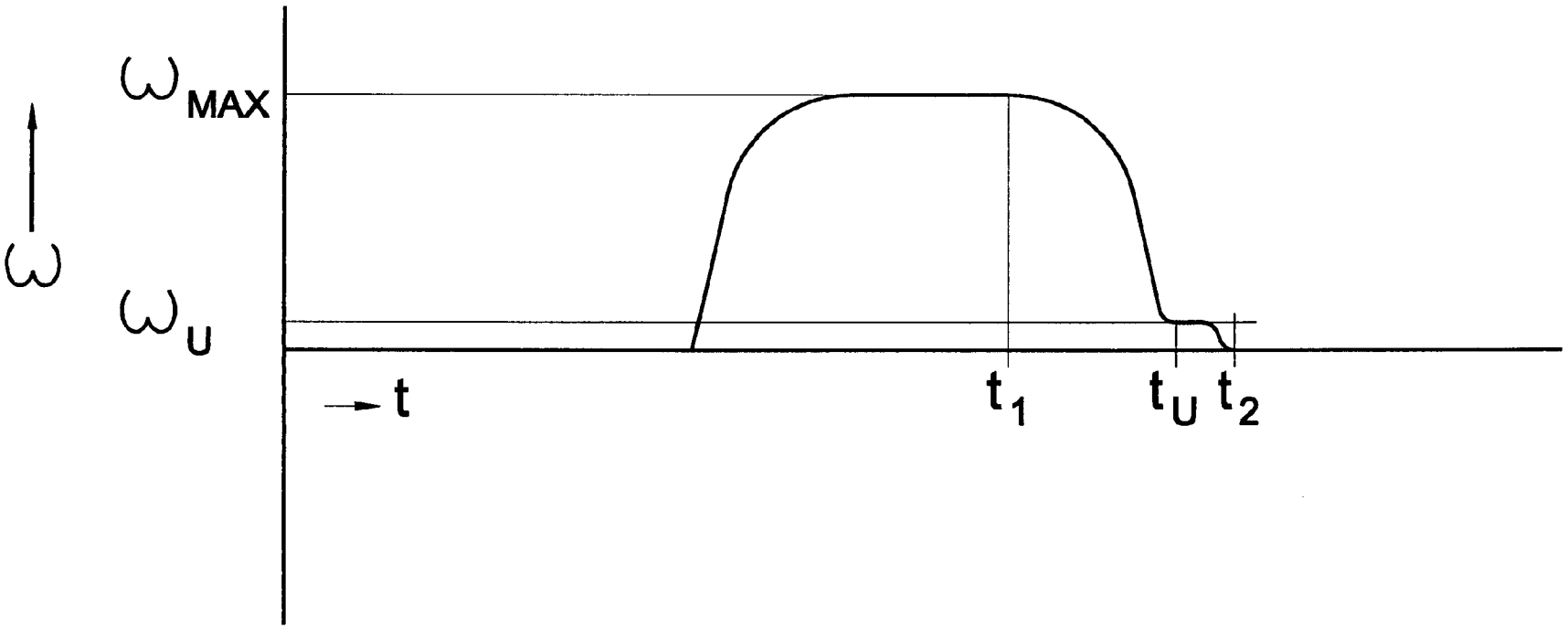
FIG. 6 is a time-speed diagram of an alternative speed curve of the apparatus shown in FIGS. 1 and 2 in operation.

It will be clear to one skilled in the art that within the framework of the present invention, many alternative embodiments and modes exist. A particularly advantageous mode with which it is ensured that the intended end position is reached, is illustrated by FIG. 6. According to the speed diagram presented therein, the rotor 5 is from a time $t_1$ only actively decelerated to a particular minimum speed $\omega_{min}$. In the example shown, the minimum speed $\omega_{min}$ is achieved at a time $t_u$ prior to the time $t_2$ at which the rotor 5 has reached its end position. The drive of the rotor is then so controlled that the minimum speed $\omega_{min}$ is maintained until the intended end position has been reached. As minimum speed $\omega_{min}$ a speed is chosen which, on the one hand, is so low that the moving cams 18 can unobjectionably engage in the recesses 44, 45, but which, on the other hand, is as high as possible to limit as much as possible the delay entailed in rotation at the minimum speed. By stopping active deceleration as soon as a predetermined minimum speed $\omega_{min}$ has been achieved, the advantage is achieved that it is ensured in a simple manner that the end position is reached in any event. Further, it is then made possible to choose the moment $t_1$ of commencing deceleration so early that even under favorable circumstance (as in case of a heavy loading) the speed when reaching the intended end position is sufficiently low. When the minimum speed $\omega_{min}$ is then achieved at a time $t_u$ prior to the time $t_2$ at which the rotor 5 has reached its end position, the run-out at the minimum speed $\omega_{min}$ ensures that the intended end position is still reached. Depending on the application, it is also possible, instead of using a minimum speed $\omega_{min}$ to accelerate or decelerate to a minimum speed difference $\Delta\omega_{min}$.

What is claimed is:

1. A method for accurately manipulating at least one sheet, comprising:

in a first time interval, accelerating or decelerating said at least one sheet, another sheet or a holder or receiving a sheet;

measuring at least one quantity which forms a measure for said deceleration or acceleration in said first time interval;

registering at least one measuring result obtained upon measuring; and subsequently determining in accordance with said registered measuring result a moment at which an acceleration or deceleration of said at least one sheet in a second time interval after said first time intervals started.

2. A method according to claim 1, wherein said manipulation is formed by a movement from a standstill, starting with an acceleration and ending with a deceleration to at most a predetermined minimum speed.

3. A method according to claim 2, wherein said first time interval precedes the acceleration of said at least one sheet, and wherein said quantity which is measured is the deceleration of said at least one sheet, another sheet or a holder for receiving a sheet.

4. A method according to claim 2, wherein said at least one quantity which is measured is the brake path from a particular first speed to a particular, lower second speed or standstill.

5. A method according to claim 2, wherein said at least one quantity which is measured is the braking time from a particular first speed to a particular, lower second speed or standstill.

6. A method according to claim 2, wherein said at least one quantity is measured during an acceleration preceding said deceleration, which acceleration forms part of said movement of said at least one sheet.

7. A method according to claim 6, wherein said at least one quantity which is measured is the acceleration of said at least one sheet.

8. A method according to claim 6, wherein said at least one quantity which is measured is the path traveled by said at least one sheet during said acceleration from a standstill or a particular first speed to a particular second speed.

9. A method according to claim 6, wherein said at least one quantity which is measured is the time which has lapsed during said acceleration of said at least one sheet from a standstill or a particular first speed to a particular second speed.

10. A method according to claim 1, wherein said movement is formed by an acceleration started at a particular moment followed by passing a particular point, and wherein said at least one quantity which is measured in said first time interval is the time duration between the start of said acceleration and the moment of passing said particular point.

11. A method according to claim 1, wherein each of said accelerations and decelerations in said first time interval and in said second time interval are carried out without being controlled.

12. An apparatus for accurately manipulating at least one sheet, comprising:

means for at least accelerating or decelerating at least one sheet;

at least one measuring means for measuring at least one quantity which forms a measure for the deceleration or acceleration of said at least one sheet;

a control means for operating said means for at least accelerating or decelerating at least one sheet;

wherein said control means is arranged for obtaining in cooperation with said at least one measuring means at least one measuring result which represents a deceleration or acceleration of said at least one sheet within a first time interval, for registering said measuring result and for determining, in accordance with said registered measuring result, a moment at which an acceleration or deceleration in a second time interval is started.

13. An apparatus according to claim 12, wherein the means for accelerating and decelerating said at least one sheet comprise and electric motor, and wherein the control means is arranged for determining the moment at which the deceleration in said second time interval is started in linear dependency on the instantaneous speed of said at least one sheet.

* * * * *

UNITED STATES PATENT AND TRADEMARK OFFICE

CERTIFICATE OF CORRECTION

PATENT NO. : 6,296,246 B1
DATED : October 2, 2001
INVENTOR(S) : Peter Renze Boorsma It is certified that error appears in the above-identified patent and that said Letters Patent is hereby corrected as shown below:

Title page,
Item [73], Assignee, in Assignee's name, "Neopast B.V." should read
-- Neopost B.V. --.

Signed and Sealed this

Twenty-third Day of July, 2002

*Attest:*

*Attesting Officer*

JAMES E. ROGAN
*Director of the United States Patent and Trademark Office*